US008256745B2

(12) United States Patent
Latoria

(10) Patent No.: US 8,256,745 B2
(45) Date of Patent: Sep. 4, 2012

(54) PORTABLE HOIST

(75) Inventor: Joseph S. Latoria, West Chicago, IL (US)

(73) Assignee: Huskie Tools, Inc., Glendale Heights, IL (US)

( * ) Notice: Subject to any disclaimer, the term of this patent is extended or adjusted under 35 U.S.C. 154(b) by 11 days.

(21) Appl. No.: 12/885,931

(22) Filed: Sep. 20, 2010

(65) Prior Publication Data

US 2012/0068131 A1 Mar. 22, 2012

(51) Int. Cl.
*B66D 1/20* (2006.01)

(52) U.S. Cl. ..... 254/346; 254/342; 254/352; 254/362; 254/376; 254/380

(58) Field of Classification Search ..... 254/278, 254/283, 342, 346, 352, 362, 376, 380
See application file for complete search history.

(56) References Cited

U.S. PATENT DOCUMENTS 4,613,273 A * 9/1986 Wagner ..... 414/463
4,884,784 A * 12/1989 Nix et al. ..... 254/362
5,607,143 A * 3/1997 Regal ..... 254/342
6,027,103 A * 2/2000 Painter ..... 254/332
6,179,270 B1 * 1/2001 Higdon ..... 254/358
6,241,215 B1 * 6/2001 Gersemsky et al. ..... 254/342
7,014,172 B2 * 3/2006 Kataoka ..... 254/338
7,090,200 B2 * 8/2006 Morse et al. ..... 254/332
7,226,041 B2 * 6/2007 Ledford ..... 254/342
7,469,881 B2 * 12/2008 Alipour et al. ..... 254/362
8,056,884 B2 * 11/2011 LaFreniere ..... 254/376

OTHER PUBLICATIONS

Little Mule Brochure re Lineman's Hoist—Exclusive Features From the Reliable Leader © 2004.

* cited by examiner

*Primary Examiner* — Emmanuel M Marcelo
(74) *Attorney, Agent, or Firm* — Wood Phillips Katz Clark & Mortimer

(57) ABSTRACT

A portable strap hoist comprises a generally rectangular frame. An upper hook is mounted at a top of the frame for mounting the frame to a structure, in use. A drum includes an insulated strap wound about the drum supporting a lower hook for supporting a load, in use. A spline shaft is operatively associated with the drum to rotatably mount the drum to the frame. A driven gear is mounted to the shaft. A portable housing is mounted to the frame and includes a handle and a drive in the portable housing including a drive gear operatively engaging the driven gear.

17 Claims, 5 Drawing Sheets

PORTABLE HOIST

CROSS REFERENCE TO RELATED APPLICATIONS

There are no related applications.

FIELD OF THE INVENTION

This invention relates to a lineman's hoist and, more particularly, to a battery powered insulated strap hoist.

BACKGROUND OF THE INVENTION

A hoist is generally a machine used to lift and lower heavy loads. The hoist can be permanently mounted, such as to a trolley, or can be portable and mounted using a hook or lug to a support structure. Hoists can be powered by hand, or by electricity, or by pneumatics, depending on the configuration and intended use.

One type of hoist is a lever operated hoist, also referred to as a "come-a-long". The hoist uses a lever or handle which is reciprocated to raise and/or lower the load. The typical lever operated hoist includes a frame supporting a lifting medium such as a chain, rope or insulated strap wound about a drum. A braking mechanism, typically a ratchet and pawl, is used to maintain the hoist in a desired position during use.

One specific application for a lever operated hoist is referred to a lineman's hoist as it is typically used by a lineman working on electrical power lines. The typical lineman's hoist uses an insulated strap. A lineman's hoist may be used in difficult applications, such as working on lines mounted atop a power pole or the like. As such, portability and ease of operation are important. In some instances, operating a lever may be difficult.

The present invention is directed to solving one or more of the problems discussed above in a novel and simple manner.

SUMMARY OF THE INVENTION

In accordance with the invention, there is provided a portable, battery powered hoist.

There is disclosed in accordance with one aspect of the invention a portable, battery powered hoist comprising a frame. An upper hook is mounted at a top of the frame for mounting the frame to a structure, in use. A drum includes a lifting medium wound about the drum. A shaft is operatively associated with the drum to rotatably mount the drum to the frame. A driven gear is mounted to the shaft. A portable housing is mounted to the frame including a handle and a battery powered drive in the portable housing including a drive gear operatively engaging the driven gear.

It is a feature of the invention that the lifting medium comprises an insulating strap supporting a lower hook for supporting a load, in use.

It is another feature of the invention that the drum comprises a spool having a ratchet wheel on one end and further comprising a lever operated pawl system for selectively engaging the ratchet wheel to manually rotate the drum relative to the frame.

It is a further feature of the invention that the lever operated pawl system includes a free wheel lever to selectively disengage the ratchet wheel.

It is yet another feature of the invention to provide a winding wheel mounted to the shaft opposite the drive gear. The shaft may be axially movable relative to the frame to selectively disengage the shaft from the driven gear.

It is another feature of the invention that the shaft includes a pin, and a collar mounted to the shaft includes an elongate holding slot for receiving the pin incident to the shaft engaging the drive gear.

It is still another feature of the invention that the battery is removably mountable to the housing.

It is still a further feature of the invention that the housing comprises a head mounted to the handle and further comprising a bracket mounting the head to the frame.

It is still another feature of the invention that the shaft comprises a spline shaft.

There is disclosed in accordance with another aspect of the invention a portable strap hoist comprising a generally rectangular frame. An upper hook is mounted at a top of the frame for mounting the frame to a structure, in use. A drum includes an insulated strap wound about the drum supporting a lower hook for supporting a load, in use. A spline shaft is operatively associated with the drum to rotatably mount the drum to the frame. A driven gear is mounted to the shaft. A portable housing is mounted to the frame and includes a handle and a drive in the portable housing including a drive gear operatively engaging the driven gear.

Further features and advantages of the invention will be readily apparent from the specification and from the drawings.

DETAILED DESCRIPTION OF THE INVENTION

Figure 1:
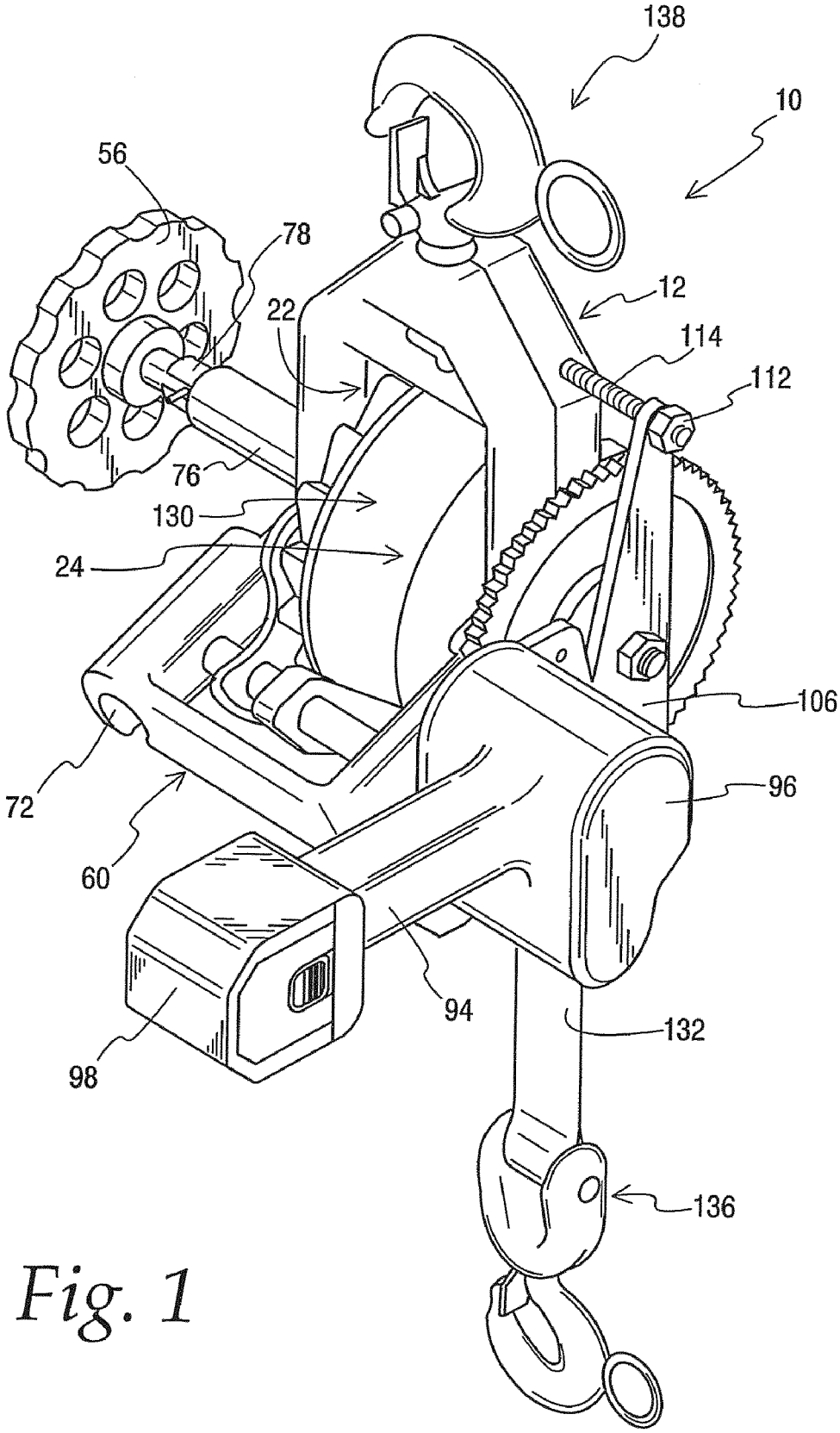
FIG. 1 is a perspective view of a portable strap hoist in accordance with the invention.

Referring to FIG. 1, a battery powered insulated strap hoist 10 in accordance with the invention is illustrated. The hoist 10 is particularly adapted for use as a lineman's hoist, although the hoist 10 is not limited to such intended use.

The hoist 10 comprises a known lever operated hoist adapted to include a battery powered drive. The hoist 10 also includes structure to enable disengagement of the battery powered drive to provide for manual operation. Particularly, the illustrated hoist 10 comprises a conventional lineman's hoist as manufactured by Little Mule Products modified to operate with the battery powered drive. By selectively disengaging the battery operated drive, as described below, the hoist 10 is used in the conventional manner for a lever operated lineman's hoist. The details of such manual operation are known in the industry and are not described in detail herein.

Figure 2:
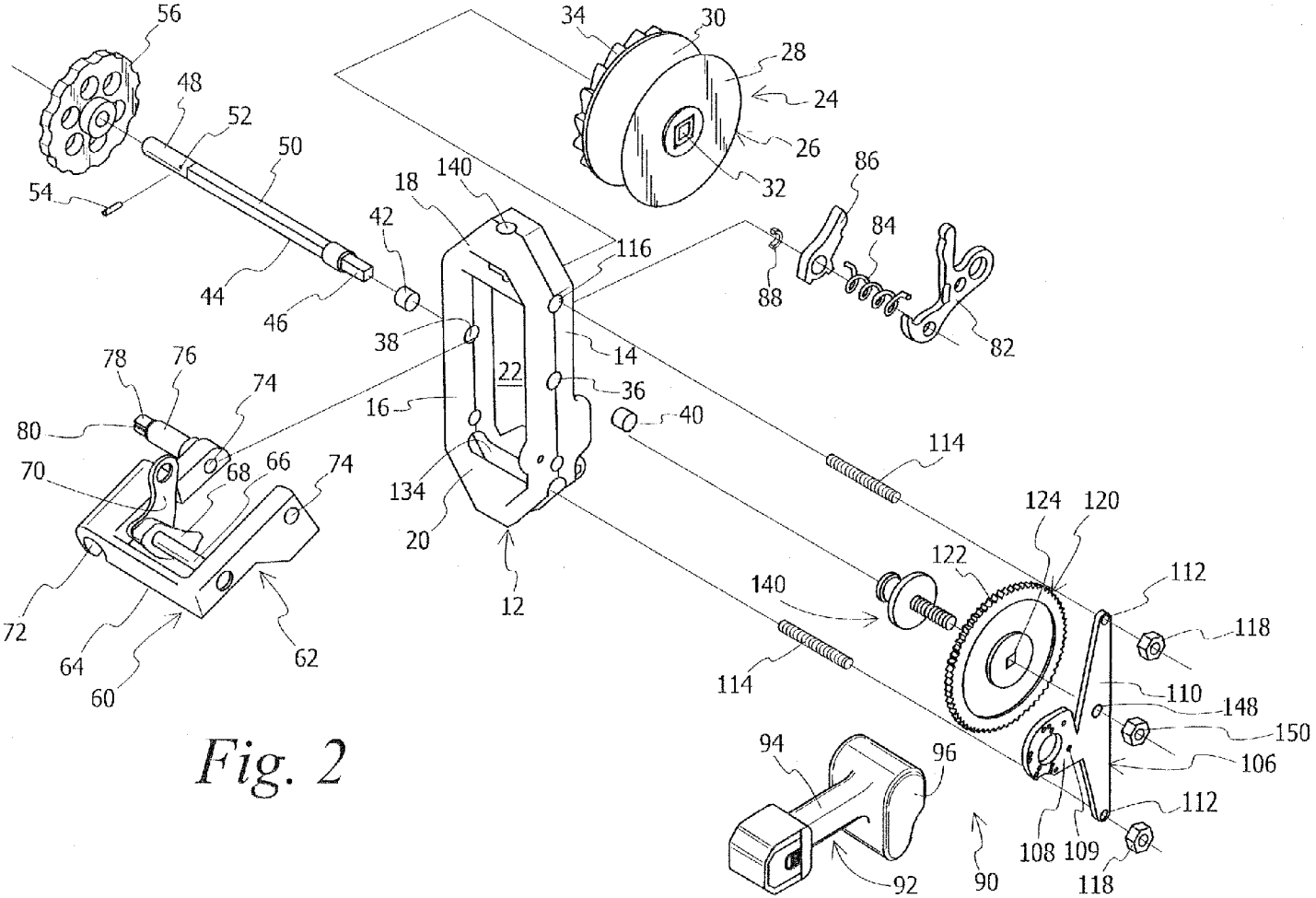
FIG. 2 is an exploded view, with parts removed, of the portable strap hoist of FIG. 1.
Figure 3:
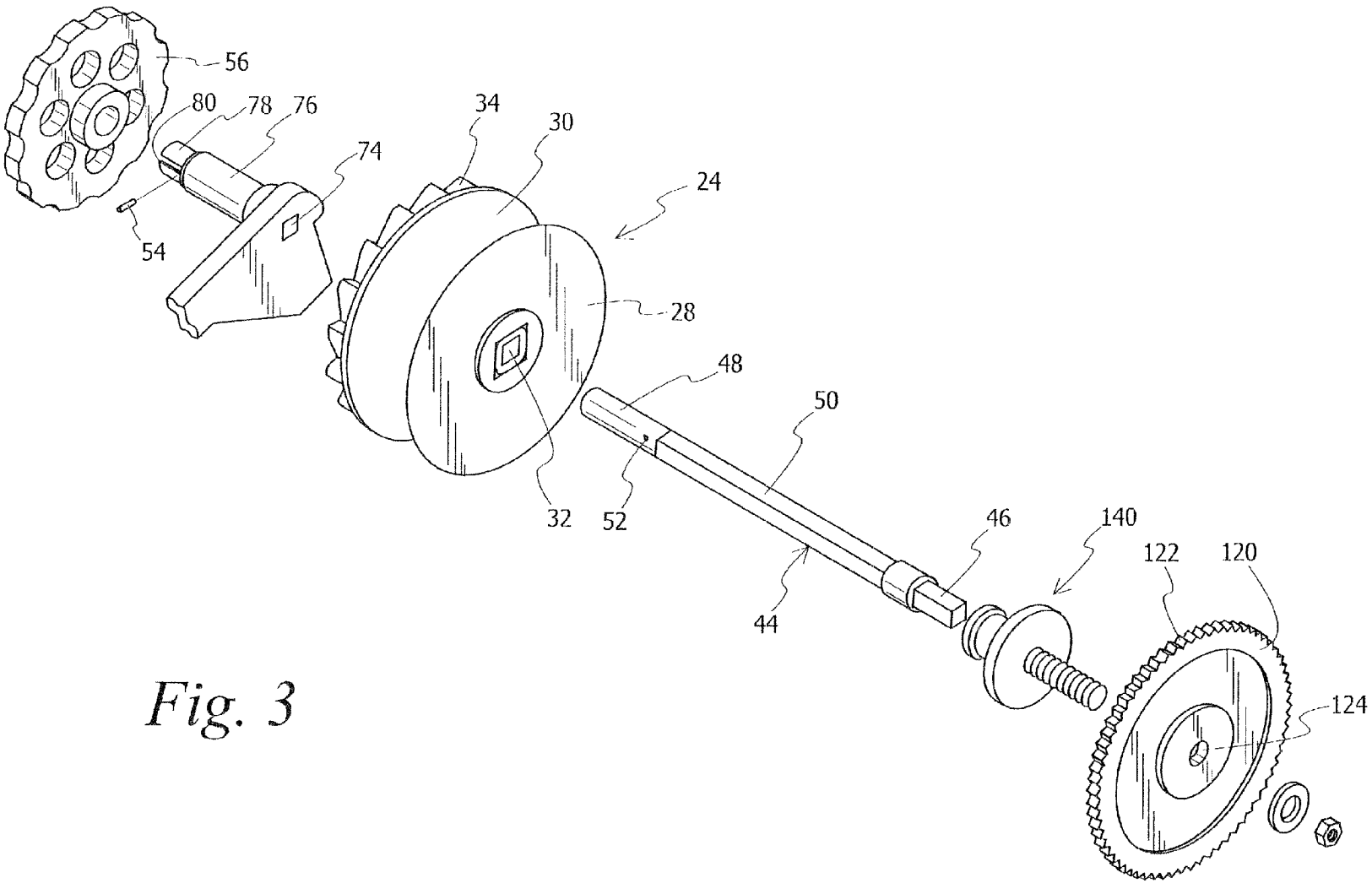
FIG. 3 is an exploded view of the drive system of the portable strap hoist of FIG. 1.

Referring also to FIG. 2, the hoist 10 comprises a frame 12. The frame 12 is of one piece construction and may be formed of aluminum, steel or cast iron. The frame 12 is generally rectangular. The frame 12 comprises a first side 14 and opposite side 16 connected at one end by a top 18 and another end by a bottom 20. The sides 14 and 16 are longer than the top 18 and bottom 20. The top 18 and bottom 20 are generally triangular in shape to provide a greater thickness in a middle portion. The frame 12 defines a generally rectangular opening 22.

A drum 24 is rotatably mounted, as described below, in the opening 22. The drum 24 is in the form of a spool 26 having opposite circular walls 28 and 30. The walls 28 and 30 are connected by a hub (not shown), as is known, having a central opening 32 therethrough. The central opening 32 is of squared cross section as can be seen in FIG. 2. The second circular wall 30 includes an outwardly facing ratchet wheel 34.

The frame sides 14 and 16 include respective, aligned center bores 36 and 38. The respective bores 36 and 38 receive bushings 40 and 42. A spline shaft 44 is received in the bushings 42 and 40 and rotatably supports the drum 24 in the space 22. Particularly, the shaft 44 comprises a splined shaft of a size and shape to be received in the drum opening 32. The shaft 44 includes a squared first end 46, and opposite cylindrical second end 48. The middle portion of the shaft 44, as at 50, carries the drum 24 and is rectangular for rotating the drum 24. A radially extending blind bore 52 is provided near the second end 48 for receiving a pin 54. A winding wheel 56 is mounted to the shaft second end 48 by a fastener (not shown).

The hoist 10 includes a lever operated pawl system 60 for selectively engaging the ratchet wheel 34 in a conventional manner to manually rotate the drum 24 relative to the frame 14. Particularly, the pawl system 60 is a standard component of the conventional lineman's hoist, except as described herein.

The pawl system 60 comprises a U-frame assembly 62 including a generally U-shaped frame 64 supporting a pawl shaft 66. A first pawl 68 and reversing lever 70 are mounted to the pawl shaft 66. The U-frame 64 includes an adaptor opening 72 for selectively receiving a lever or rod or the like (not shown) for manually operating the hoist 10, as is conventional. The U-frame 64 includes aligned openings 74 for receiving the shaft 44. In accordance with the invention, the conventional lever operated pawl system U-frame is modified to include a hollow collar 76 attached to the frame 64 and aligned with the opening 74 on the side of the U-frame 64 including the lever adaptor 72. The collar 76 journals a slotted bushing 78 that extends outwardly at a distal end including an elongate slot 80 for selectively receiving the pin 54, as described below.

The pawl system 60 further comprises a free wheel lever 82, pawl spring 84, second pawl 86 and a retaining ring 88 selectively mounted to the frame 14 in a conventional manner.

As is known, the reversing lever 70 can be selectively positioned in an upper position, as shown in FIG. 2, to engage the loading pawl 66 against the teeth of the ratchet wheel 34. The reversing lever 70 can be placed in an opposite position to lower using the holding pawl 86 and the ratchet wheel 34. The freewheeling lever 82 is selectively operated in a conventional manner to disengage the pawl system 60 so that the drum 24 is freewheeling relative to the pawl system 60. In the freewheeling mode, the drum 24 can be turned by turning the winding wheel 56 or using battery powered operation, as described below.

In accordance with the invention, a battery powered drive 90 is mounted to the frame 14. The drive 90 includes a housing 92 including a gripping handle 94 connected to a head 96. The housing 92 is generally similar to a conventional portable tool, such as a cordless drill. A battery 98 is removably mounted to the housing 92, in a conventional manner, and powers a battery operated drive 100, see FIG. 5, for operating a drive gear 102. The drive 100 is in the housing 92. The drive 100 converts electrical power from the battery 98 to drive the drive gear 102 in a conventional manner using a switch 104. For example, the drive 100 may be generally similar to a conventional cordless drill, except that a chuck is replaced with the drive gear 102. Alternatively, the drive 100 could be operated off a 120 volt AC supply and include a power cord, as will be apparent. The switch 104 is movable between a center off position and up and down position for forward and reverse rotational movement of the drive gear 102, as described below.

In accordance with the invention, the battery 98 may comprise a conventional, interchangeable 14.4 volt battery. The battery at 98 is rechargeable in a conventional manner for cordless power tools.

A bracket 106 mounts the housing 92 to the frame 14. Particularly, the bracket 106 includes a bottom annular portion 108 mounted to the head 96, using six screws, not shown, through openings, one of which is labeled 109. An elongate beam 110 is connected to the annular connecting portion 108. The beam 110 includes opposite openings 112. Threaded fasteners 114 are received in threaded openings 116, one of which is shown, in the frame first side 14. The fasteners 114 pass through the openings 112 and are secured thereon using nuts 118 to mount the housing 92 to the frame 12.

Figure 4:
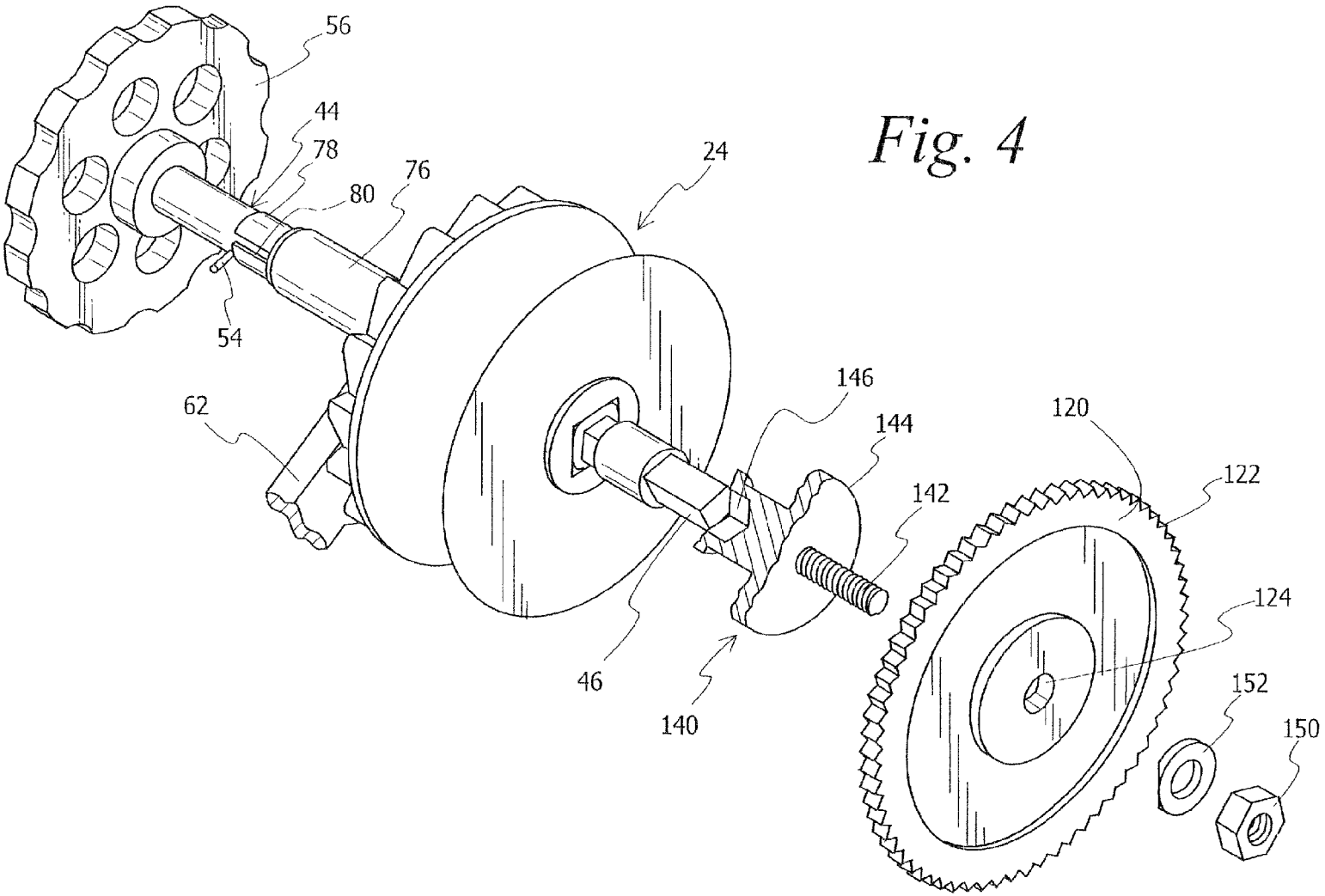
FIG. 4 is a partial, perspective view illustrating the drive system in a disengaged position.
Figure 5:
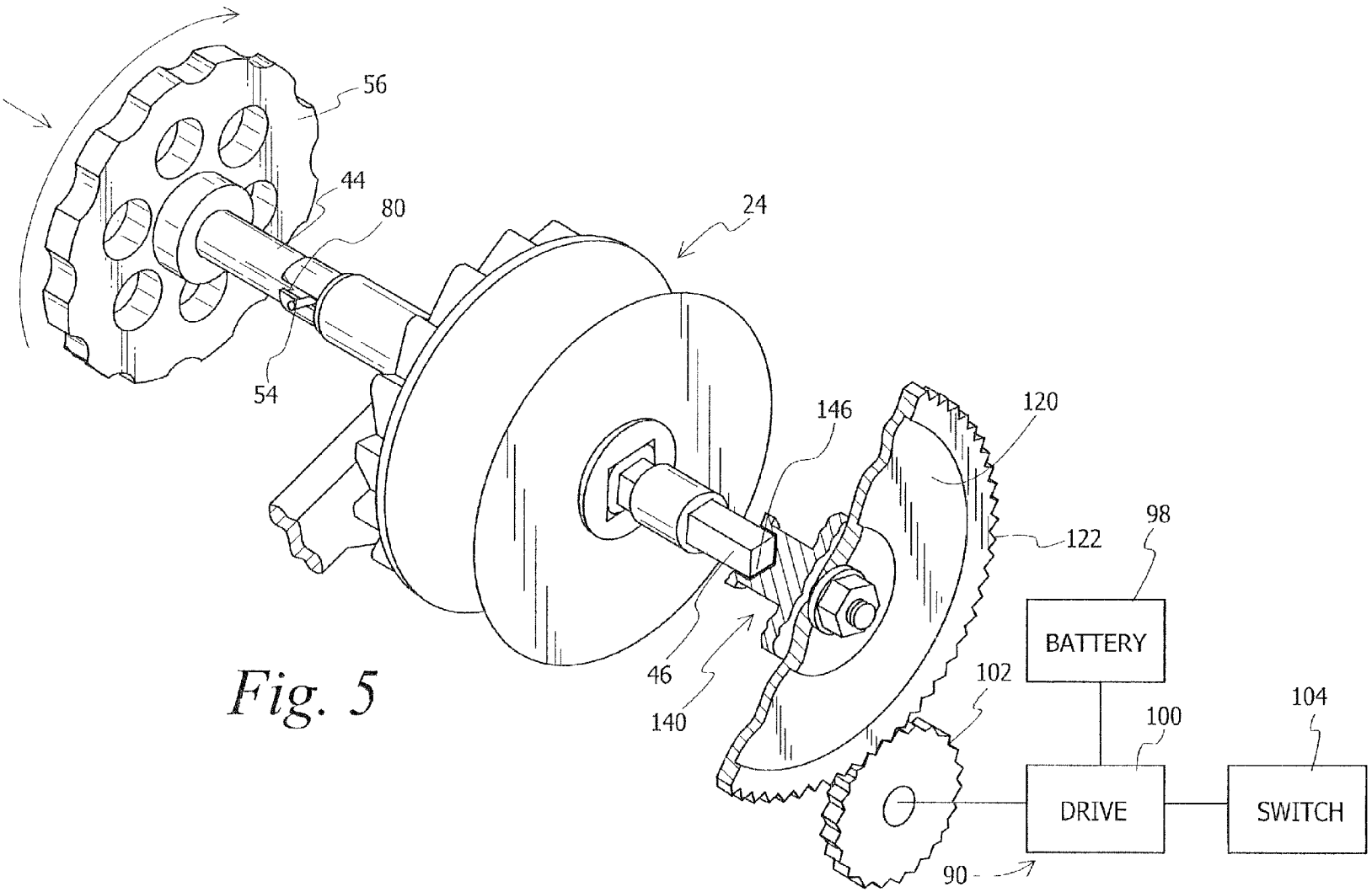
FIG. 5 is a perspective view, similar to FIG. 4, illustrating the driven system in an engaged position for battery powered operation.

A driven gear 120 includes outer teeth 122 for engaging the drive gear 102, as shown in FIG. 5. The driven gear 120 includes an axial opening 124. The driven gear 120 is rotatably mounted to the bracket 106 with an adapter bolt 140. As shown in FIG. 4, the adapter bolt 140 includes a threaded element 142 extending axially from an enlarged head 144 having a square shaped blind bore 146. The blind bore 146 is sized to selectively receive the shaft squared first end 46. The threaded element 142 extends through the driven gear axial opening 124 and a central opening 148 in the bracket beam 110 and receives a nut 150 and washer 152 to rotatably mount the driven gear 120 to the bracket 106. The adapter bolt head 144 may be operatively secured to the driven gear 120 by friction fit or welding, or the like, so that the adapter bolt 140 is rotatable therewith.

As is conventional, the drum 24 includes a lifting medium 130 in the form of an insulating strap 132 wound about the drum 24. The strap 132 passes through an elongate slot 134, see FIG. 2, in the frame bottom portion 20. A lower hook and yolk assembly 136 of conventional construction is secured to an end of the strap 132.

A top hook and latch assembly 138 is mounted to the frame top portion 18 through an opening 140, see FIG. 2, in a conventional manner.

In use, the top hook and latch assembly 138 can be mounted to a suitable structure, in use. The bottom hook and yolk assembly 136 would be connected to a load. In accordance with the invention, the shaft 44 is axially movable relative to the frame 12 to selectively disengage the shaft 44 from the driven gear 120 to provide for manual operation. This is illustrated in FIG. 4. The winding wheel 56 is used to pull the shaft 44 away from the drum 24 so that the pin 54 is out of the collar elongate slot 80. As a result, the shaft first end 46 is spaced from the adapter bolt blind bore 146, as shown, to disengage the driven gear 120. In the disengaged mode, the winding wheel 56 can be used to rotate the drum 24. Alternatively, the freewheeling lever 82 can be disengaged in the normal manner to operate the hoist using the pawl system 60 in association with the ratchet wheel 34.

By turning the winding wheel 56, as shown in FIG. 5, the pin 54 can be aligned with the collar elongate slot 80 and the winding wheel 56 pushed inwardly toward the drum 24 so that the shaft first end 46 is selectively received in the adapter bolt blind bore 146, as shown. In the engaged mode, the winding wheel 56 is not used as the motive power is taken over by the battery powered drive 90. To ensure proper operation, the freewheeling lever 82 must be placed in the conventional freewheeling position.

With battery powered operation, the switch 104 is turned to forward or reverse to controllably rotate the drive gear 102. Rotation of the drive gear 102 causes corresponding rotation of the driven gear 120 to in turn rotate the shaft 44, via the adapter bolt 140. Rotation of the shaft 44 turns the drum 24 to raise or lower the strap 132 and the bottom hook and yolk assembly 136, as is apparent.

In accordance with the invention, the hoist 10 operates on regular, interchangeable batteries. The strap 132 can be free spooled, by disengaging the battery power system, as shown in FIG. 4, to take up line slack and then be engaged, as shown in FIG. 5, so it may be motorized for tough pulling. The hoist 10 enables a user using only one hand to simply raise and lower a load, such as an electrical power line.

The hoist 10 includes an emergency manual take up and release operation using the pawl system 60 in the conventional manner if battery power runs out. The use of a single hook and yolk assembly 136 and strap 132 is rated at 1500 lbs. safe working load. When the strap is doubled up and the hook and yolk assembly 136 is attached to the frame 12 in a conventional manner, not shown, the rated safe working load is 3,000 lbs. The hoist 10 is thus designed to assist a lineman by providing an enlarged margin of safety as well as easing effort when pulling in tension cables.

Thus, in accordance with the invention, there is provided a portable, battery operated strap hoist including a free spool of release.

I claim:

1. A portable, battery powered hoist comprising:
a frame;
an upper hook mounted at a top of the frame for mounting the frame to a structure, in use;
a drum including a lifting medium wound about the drum;
a shaft operatively associated with the drum to rotatably mount the drum to the frame;
a driven gear mounted to the shaft; and
a portable housing mounted to the frame including a handle and a battery powered drive in the portable housing including a drive gear operatively engaging the driven gear,
wherein the drum comprises a spool having a ratchet wheel on one end and further comprising a lever operated pawl system for selectively engaging the ratchet wheel to manually rotate the drum relative to the frame.

2. The portable, battery powered hoist of claim. 1 wherein the lifting medium comprises an insulating strap supporting a lower hook for supporting a load, in use.

3. The portable, battery powered hoist of claim 1 wherein the lever operated pawl system includes a free wheel lever to selectively disengage the ratchet wheel.

4. The portable, battery powered hoist of claim 1 wherein the battery powered drive comprises a battery removably mountable to the housing.

5. The portable, battery powered hoist of claim 1 wherein the housing comprises a head mounted to the handle and further comprising a bracket mounting the head to the frame.

6. The portable, battery powered hoist of claim 1 wherein the shaft comprises a spline shaft.

7. A portable, battery powered hoist comprising:
a frame;
an upper hook mounted at a top of the frame for mounting the frame to a structure, in use;
a drum including a lifting medium wound about the drum;
a shaft operatively associated with the drum to rotatably mount the drum to the frame;
a driven gear mounted to the shaft;
a portable housing mounted to the frame including a handle and a battery powered drive in the portable housing including drive gear operatively engaging the driven gear; and
a winding wheel mounted to the shaft opposite the driven gear.

8. The portable, battery powered hoist of claim 7 wherein the shaft is axially moveable relative to the frame to selectively disengage the shaft from the driven gear.

9. The portable, battery powered hoist of claim 8 wherein the shaft includes a pin and a collar mounted to the shaft includes an elongate holding slot for receiving the pin incident to the shaft engaging the drive gear.

10. A portable strap hoist comprising:
a generally rectangular frame;
an upper hook mounted at a top of the frame for mounting the frame to a structure, in use;
a drum including an insulated strap wound about the drum supporting a lower hook for supporting
a load, in use;
a splined shaft operatively associated with the drum to rotatably mount the drum to the frame;
a driven gear mounted to the shaft; and
a portable housing mounted to the frame including a handle and a drive in the portable housing including a drive gear operatively engaging the driven gear,
wherein the drum comprises a spool having a ratchet wheel on one end and further comprising a lever operated pawl system for selectively engaging the ratchet wheel to manually rotate the drum relative to the frame.

11. The portable strap hoist of claim 10 wherein the drive comprises a battery powered drive.

12. The portable strap hoist of claim 11 wherein the battery powered drive comprises a battery removably mountable to the housing.

13. The portable strap hoist of claim 10 wherein the lever operated pawl system includes a free wheel lever to selectively disengage the ratchet wheel.

14. The portable strap hoist of claim 10 wherein the housing comprises a head mounted to the handle and further comprising a bracket mounting the head to the frame.

15. A portable strap hoist comprising:
a generally rectangular frame;
an upper hook mounted at a top of the frame for mounting the frame to a structure, in use
a drum including an insulated strap wound about the drum supporting a lower hook for supporting a load, in use;
a splined shaft operatively associated with the drum to rotatably mount the drum to the frame;
a driven gear mounted to the shaft and
a portable housing mounted to the frame including handle and a drive in the portable housing including a drive gear operatively engaging the driven gear further comprising a winding wheel mounted to the shaft opposite the driven gear.

16. The portable strap hoist of claim 15 wherein the shaft is axially moveable relative to the frame to selectively disengage the shaft from the driven gear.

17. The portable strap hoist of claim 16 wherein the shaft includes a pin and a collar mounted to the shaft includes an elongate holding slot for receiving the pin incident to the shaft engaging the drive gear.

* * * * *